United States Patent [19]

Alshits et al.

[11] 4,152,850

[45] May 8, 1979

[54] BUCKET-WHEEL TRENCH EXCAVATOR HAVING A FOUR-ELEMENT ARTICULATED LINKAGE INCLUDING TWO PIVOTABLY CONNECTED HYDRAULIC CYLINDERS

[76] Inventors: Mark Z. Alshits, ulitsa Vakhtangova, 6, kv. 44; Anatoly A. Kalugin, Leninsky prospekt 60/2, korpus 6, kv. 77; Gennady I. Sokolov, 2 Vladimirskaya ulitsa, 47/13, korpus 2, kv. 203, all of Moscow; Evgeny P. Kovalev, ulitsa Stroitelei, 2, korpus 3, kv. 86, Ljubertsy Moskovskoi oblasti, all of U.S.S.R.

[21] Appl. No.: 850,702

[22] Filed: Nov. 10, 1977

Related U.S. Application Data

[63] Continuation of Ser. No. 666,157, Mar. 11, 1976, abandoned.

[30] Foreign Application Priority Data

Mar. 12, 1975 [SU] U.S.S.R. ..... 2117698

[51] Int. Cl.[2] ..... E02F 5/08

[52] U.S. Cl. ..... 37/97; 212/66

[58] Field of Search ..... 37/90, 91, 94–97, 37/190; 212/66, 69, 9, 41, 58 R, 59 R; 214/77 R

[56] References Cited

U.S. PATENT DOCUMENTS

| | | | |
|---|---|---|---|
| 1,280,701 | 10/1918 | French | 37/90 |
| 1,321,983 | 11/1919 | Cole | 212/69 UX |
| 2,834,125 | 5/1958 | Brant | 37/97 |
| 3,226,856 | 1/1966 | Penote | 37/190 X |
| 3,276,059 | 10/1966 | Allen | 214/77 R X |
| 3,510,970 | 5/1970 | Mikhailov et al. | 37/94 |
| 3,863,988 | 2/1975 | Bartels | 37/97 X |

FOREIGN PATENT DOCUMENTS

| | | | |
|---|---|---|---|
| 1281863 | 10/1968 | Fed. Rep. of Germany | 214/77 R |
| 916231 | 1/1963 | United Kingdom | 212/69 |
| 1167821 | 10/1969 | United Kingdom | 212/69 |
| 377486 | 6/1973 | U.S.S.R. | 37/97 |

*Primary Examiner*—Clifford D. Crowder
*Attorney, Agent, or Firm*—Haseltine, Lake & Waters

[57] ABSTRACT

A bucket-wheel trench excavator comprising a prime mover and an excavating unit arranged to bear on a wheeled support. The frame of the excavating unit is connected to the frame of the prime mover by means of an intermediate frame and horizontal-pivoted joints. Displacement of the excavating unit between the working position and the transport position is effected by two hydraulic cylinders which, in conjunction with the frames, form at least one four-element linkage wherein the intermediate frame and the excavating unit frame are rigid members and the hydraulic cylinders are connected end-to-end. The effect kinematic connection between the two frames and the hydraulic cylinders, provision is made for a strut connecting the four-element linkage joints provided between the rigid frames and between the hydraulic cylinders. To enable the excavating unit to turn about a vertical axis relative to the prime mover, provision is made for a flat turntable which comprises a rotatable disk and a crossmember connected to the intermediate frame by horizontal-pivoted frames.

5 Claims, 7 Drawing Figures

BUCKET-WHEEL TRENCH EXCAVATOR HAVING A FOUR-ELEMENT ARTICULATED LINKAGE INCLUDING TWO PIVOTABLY CONNECTED HYDRAULIC CYLINDERS

CROSS-RELATED APPLICATION

This application is a continuation of Ser. No. 666,157 filed Mar. 11, 1976 and now abandoned.

FIELD OF THE INVENTION

The present invention relates to excavating machines designed primarily for trenching and has particular reference to bucket-wheel trench excavators.

Bucket-wheel trench excavators constructed in accordance with the present invention can be used in industrial and civil construction and in water conduit and pipeline laying applications, particularly in laying oil and gas pipelines.

BACKGROUND

Bucket-wheel trench excavators have been known to be successfully used for digging long trenches in various types of ground.

In these applications cyclic-action single-bucket excavators and continuous-action chain-bucket excavators show by far lower working rate and dependability and are incapable of giving steady performance under conditions of difficult and frozen ground.

Widely known in the art are bucket-wheel trench excavators constructed as a tracked or, occasionally, wheeled tractor carrying a mounted bucket-wheel excavating unit arranged to be raised into the transport position and be maintained therein by means of an appropriate lift mechanism, whereas in the working position the front end of said excavating unit bears on the tractor and the rear end rests on a rigid sliding support moving on the trench bottom.

For the tractor to be capable of lifting and carrying a substantially big and heavy excavating unit located with a considerable backward offset, it should possess a large margin of stability and load carrying capacity, which necessitates increase in the weight of the whole machine. It has been found that the tractor of such an excavating machine is 1.5–2 times as heavy as the excavating unit.

The extension of the scope of the bucket-wheel trench excavators, the adaptation of these machines for digging difficult and frozen ground, and also the increase in the size of piping and trenches dealt with necessitate increase in the driving power and working capacity of the machines under consideration. In consequence, such machines become heavier and less mobile, losing their capability of moving under their own power over long distances.

Owing to the disadvantages described above, mounted excavating machines cannot be used successfully, if at all, in a number of circumstances.

For heavy and powerful machines, it is more advantageous and economical to use a semitrailer arrangement which provides a wheeled support at the rear for the excavating unit to rest upon in the working and transport positions.

With such a constructional arrangement, the weight of the tractor is equal to that of the excavating unit, and the total weight of the machine becomes less. Somewhat impaired manoeuvrability of such machines does not hamper their operation as they are used mainly in conditions where much room is available.

Among such machines are advanced-design excavators described in USSR Inventor's Certificates No. 324343 Cl.E02f3/18 and No. 377486 Cl. E02f5/08.

The first-named machine has a semitrailed excavating unit connected by means of a vertical-pivoted joint to a cross which is held by horizontal-pivoted joints to a U-shaped frame mounted by means of horizontal-pivoted joints to the tractor. The transfer of the excavating unit into the transport position is effected by power cylinders which are articulated to the cross and U-shaped frame and are adapted for turning the U-shaped frame about the front and rear horizontal -pivoted joints.

With this constructional arrangement of coupling the excavating unit to the tractor, power can be transmitted to the excavating bucket wheel by hydraulic or electrical means, with resultant low efficiency and substantial increase in the weight of the machine.

A further disadvantage of this construction is a large transverse tilting moment arising in negotiating turns in the transport position and substantially impairing the transverse stability of the machine and the operating qualities thereof.

The construction of the second-named machine (Inventor's Certificate No. 377486), while retaining the advantages of the previously described arrangement, provides for employing a mechanical drive for the excavating unit. It consists of a prime mover, a bucket-wheel excavating unit arranged to bear on a wheeled support in the working and transport positions, and a system of frames composed of the prime mover frame and the excavating unit frame and connected to an intermediate frame by means of horizontal-pivoted joints. The prime mover frame has a vertical-pivoted joint which enables the excavating unit and the intermediate frame to turn in a horizontal plane relatively to the prime mover, whereby high transportation manoeuvrability is achieved and the machine is enabled to dig trenches with small radii of curvature. The transfer from the working position into the transport position and in reverse, and also the variation of the digging depth are effected by means of hydraulic cylinders articulated to the intermediate frame and to the frame of the excavating unit and arranged to turn the intermediate frame about the front and rear horizontal-pivoted joints.

The location of the front horizontal-pivoted joint near the mid-point of the track provides for even distribution of the ground pressure and high longitudinal stability of the tractor in relation to the jolting and oscillation of the excavating unit occurring in digging difficult and frozen ground, there being no substantial increase in the force exerted on the rear wheeled support.

Besides, the transfer of the vertical-pivoted joint forward from the position used in the construction described in Inventor's Certificate No. 324343 provides for good transverse stability of the machine when negotiating turns in the transport position.

Though progressive on the whole, these constructional arrangements of bucket-wheel trench excavators suffer materially from the disadvantage that great forces and loads arising in the power cylinders, articulated joints and frame system adversely affect the dependability of the machine and necessitate improving the strength and, consequently, increasing the weight thereof.

This disadvantage is attributed to the fact that in the transport position, when the intermediate frame has to be turned to the maximum extent in relation to the excavating unit frame, with the power cylinders fully extended, the axes of the power cylinders are displaced considerably toward the articulated joints which effect the connection between the intermediate frame and the excavating unit frame. These conditions give rise to particularly great forces in the power cylinders, the articulated joints and the metal structures of both frames and cause the power cylinders to make a longer stroke.

These drawbacks are particularly detrimental in the case of substantially big and heavy large-capacity excavating machines employed to dig trenches for maximum-diameter piping in difficult and frozen ground.

According to Inventor's Certificate No. 377486, the vertical-pivoted joint which enables the machine to make turns in the transport position and to dig trenches with small radii of curvature is located in the front portion of the prime mover frame, on the tractor main frame, and is constructed in the form of brackets positioned at different height and connected by two (upper and lower) shafts. The transmission which conveys drive to the excavating unit is situated midway between said brackets and inside the prime mover frame.

With respect to the freedom of turning in a horizontal plane about a vertical pivot, such a design of the connection between the tractor and the excavating unit suffers materially from the disadvantage that it has to employ complicated and cumbersome construction of the prime mover frame in order to accommodate and mount therein the bucket-wheel power transmission. Furthermore, access to the transmission as well as the servicing and installation thereof are difficult.

The construction of the vertical-pivoted joint has an important bearing on the functioning of the entire excavating machine inasmuch as this joint transmits all the large forces (such as pull, tilting effort, etc.) from the excavating unit to the tractor. Further, the construction of this joint must not complicate the operation and servicing of the machine.

SUMMARY OF THE INVENTION

It is an object of the present invention to provide a high-capacity bucket-wheel trench excavator capable of digging trenches for maximum-diameter piping in easy and difficult ground conditions, including frozen ground, and travelling over long distances for transportation purposes.

It is a further object of the present invention to provide an excavator having such a system for mounting and coupling the excavating unit to the tractor that will reduce the load on the structural components and decrease the weight of the entire machine.

It is a still further object of the present invention to provide an excavator having a minimum size and constructed in such a manner as to be simple to operate and convenient to service, and to give free access to the components of the power transmission, the machine being also simple to manufacture.

It is a still further object of the present invention to provide for dependable operation of the hydraulic cylinders involved by virtue of arranging for the forces which act on said hydraulic cylinders to be constantly transmitted along the axes of the cylinders.

It is a still further object of the present invention to increase the rigidity and strength of the excavating unit frame.

It is a still further object of the present invention to decrease the maximum overall height of the machine for adapting it to the conditions of railway transportation.

It is a still further object of the present invention to devise a constructional arrangement which, being dependable in operation and simple to make, will provide for transmission of pulling and tilting forces from the excavating unit to the tractor.

These and other objects are achieved by providing a bucket-wheel trench excavator comprising a prime mover, a bucket-wheel excavating unit arranged to bear on a wheeled support, and a system of frames composed of the prime mover frame and the excavating unit frame and connected to an intermediate frame by means of horizontal-pivoted joints. The prime mover frame has a vertical-pivoted joint which enables the excavating unit and the intermediate frame to turn in relation to the prime mover. The transfer from the working position into the transport position and in reverse is effected by hydraulic cylinders articulated to the intermediate frame and to the excavating unit frame and arranged to turn the intermediate frame about the front and rear horizontal pivoted joints.

According to the invention, the frames and the hydraulic cylinders form at least one four-element linkage wherein the intermediate frame and the excavating unit frame are rigid members, two hydraulic cylinders are arranged in succession, and the articulated joints provided between the rigid frames and between the hydraulic cylinders are connected by means of a strut designed to effect kinematic connection between the two frames and the hydraulic cylinders. The vertical-pivoted joint of the prime mover frame is constructed in the form of a slidably mounted flat turntable having a rotatable disk and also a crossmember connected by means of horizontal-pivoted joints to the intermediate frame.

It is desirable that the hydraulic cylinders be articulated to the excavating unit frame and the intermediate frame by means of ball joints and the piston rods of the hydraulic cylinders be connected to each other and to the strut by means of a pin, a fulcrum ball mounted thereon, and a yoke adapted to turn relatively to the strut about an axis perpendicular to the axis of the pin. To increase the rigidity and strength of the excavating unit frame, a straight top member may be provided so that the frame takes the shape of a triangulated truss.

According to another embodiment of the invention, the strut effecting kinematic connection between the frames and the hydraulic cylinders is mounted independently with respect to the lower horizontal-pivoted joint which connects the intermediate frame to the excavating unit frame.

It is desirable that a stepped recess be provided around the periphery of the turntable disk, in the bottom portion thereof, in order to accommodate a stationary ring connected to the prime mover frame. It is further desirable that a locking ring be fastened under the stationary ring on the recessed side of the disk and coaxially therewith in order to limit disk axial movement.

The principal features of the invention consist in the following:

The frames and hydraulic cylinders intended for lifting the excavating unit form a four-element linkage wherein the intermedite frame and the excavating unit frame are rigid members, the two hydraulic cylinders are arranged in succession, and the articulated joints provided between the rigid frames and between the hydraulic cylinders are connected by means of a strut designed to effect kinematic connection between the two frames and the hydraulic cylinders. Owing to this constructional arrangement, during transfer into the transport position or in varying the digging depth, when the cylinders extend and the intermediate frame turns about the front and rear horizontal-pivoted joints to either partial or full extent of its travel, i.e. throughout all the frame positions, a sufficiently long and practically non-decreasing distance is maintained between the axis of the hydraulic cylinders and the rear horizontal-pivoted joint which connects the intermediate frame to the excavating unit frame, whereby the forces and loads arising in the hydraulic cylinders, articulated joints and frame structures are kept to a minimum.

With the loads encountered in powerful, heavy machines, the force exerted by the hydraulic cylinders is of the order of 20 tons. Should the prior-art construction be used, this force would be 100–120 t (taking into account added loads and the necessary increase in the strength and weight of the structure).

An attempt at limiting the cylinder force within 20 t with the prior-art constructional arrangement would lead to exorbitant increase in the size of the machine, it being necessary to use hydraulic cylinders with a stroke of 2.3 m—a hardly achievable object from the manufacturing viewpoint. In the machine constructed according to the present invention the stroke of each cylinder is 900 mm.

In has been found by calculation and experiment that a prior-art excavator with a maximum cpacity of 1200 $m^3/h$ has a mass of 60 t. With the same capacity and size, the excavator constituting the present invention has a mass of 40 t.

The originality of achieving the objects of the invention makes it possible to provide a high-capacity excavator for use throughout the working season under conditions of difficult and frozen ground. Said excavator has a moderate weight, which feature makes the machine more handy and enables it to travel over long distances for transportation purposes. The simple design ensures dependable operation and straight forward maintenance.

The provision of the vertical-pivoted joint makes the machine manoeuvrable and enables it to dig trenches with small radii of curvature. Said vertical-pivoted joint is constructed in the form of a slidably mounted flat turntable having a rotatable disk to which is attached a crossmember with two horizontal-pivoted joints arranged to connect said crossmember to the intermediate frame. This constructional arrangement features compactness and free access to the components of the power transmission, promoting ease of operation, repair and maintenance.

According to one of the embodiments of the present invention, the hydraulic cylinders are articulated to the intermediate frame and the excavating unit frame by means of ball joints and the piston rods of the hydraulic cylinders are coaxially connected to each other and to the upper end of the strut. One of the piston rods is ball-jointed to a pin, whereas the other piston rod is connected to said pin by means of a yoke, the pin itself being connected to another yoke rotatably mounted on the strut. This constructional arrangement provides axial transmission of thrust from the hydraulic cylinders irrespective of displacement of the joints which attach them to the frames and strut, whether such displacement may be caused by faults in assembling the machine or by forces arising during the operation thereof. Another feature of this constructional arrangement consists in the freedom from bending loads on the hydraulic cylinders and the piston rods thereof.

Besides, the coaxial connection of the piston rods makes it possible to shorten the cylinder arrangement and thus render it more compact under conditions of limited space between the joints attaching the hydraulic cylinders to the frames. Where said space is not limited, another embodiment of the connection between the hydraulic cylinders and the strut may be employed wherein, instead of the coaxial cylinder attachment, separate and independent ball joints may be situated out of line and mounted on the strut at different points.

The frame of a bucket-wheel excavating unit is usually provided with an upper structure for accommodating a conveyor arranged not in a straight line and the members of such a frame are subjected to bending in addition to compression and tension.

According to the invention, inasmuch as the hydraulic cylinders included in the four-element linkage are articulated to the upper structure of the excavating unit frame, one of the embodiments of the invention provides for constructing said upper structure of the frame in the form of a straight member so that the frame takes the form of a triangulated truss whose members are subjected only to compression and tension and are not subjected to bending, whereby the strength and rigidity of the frame are increased, whereas the weight of the frame is decreased.

The overall height and the weight of excavators increase with the increase in the size of the trenches dealt with.

The endeavour to decrease loads on the stressed members and hydraulic cylinders of the mounting system without increasing the cross-sectional dimensions and weight of its structure necessitates increasing the overall and linear dimensions of said structure.

Excavators are often transported by rail or by other means which involve dimensional limitations. To meet these conditions, it is necessary to perform disassembly operations and, therefore, it is desirable that provision be made for making such excavator disassembly possibly simple.

To achieve this object, in one of the embodiments of the invention the strut which effects kinematic connection between the frames and the hydraulic cylinders is attached so that it is independent of the lower horizontal-pivoted joint connecting the intermediate frame to the excavating unit frame.

Before loading the excavator on a railway flat car or another transport means, the upper and lower buckets are removed from the bucket wheel and the excavating unit is lowared so as to rest on the bucket-wheel rims, the latter supporting the machine. Now the uppermost point which has to comply with the transport dimensional limitations is the four-element linkage upper joint which attaches the hydraulic cylinder piston rods and the strut.

Since the lower end of the strut is attached independently, it is possible to detach the pins in the strut lower joints, retract the hydraulic cylinders and lower the strut and the cylinders so as to decrease the height of the machine in transport without uncoupling the excavating unit from the tractor, to which it is connected by the intermediate frame, and without using hoisting facilities. After the machine is unloaded, the hydraulic cylinders are extended, the strut is raised and the strut lower joints are reinstalled. The feature described above makes easy the loading and unloading of the machine.

In one of the embodiments of the invention a stepped recess is provided around the periphery of the turntable disk, in the bottom portion thereof, in which is accommodated a stationary ring connected to the prime mover frame. A locking ring is fastened under the stationary ring on the recessed side of the disk and coaxially therewith in order to limit disk axial movement.

Heavy traction efforts arising in digging, especially when excavating difficult and frozen ground, and considerable tilting forces acting, with the machine in the working and transport positions, due to the high location of the centre of gravity of the excavating unit on hillsides or on inadequately graded ground, are taken by the turntable.

Inasmuch as the turntable disk, which mounts the cross-member connected to the intermediate frame, is attached to the tractor frame at the disk periphery, the efforts and forces mentioned above are taken effectively, there being no need for increasing the strength and weight of the turntable structure.

Since the turntable of the bucket-wheel trench excavator has to operate infrequently both when digging and in transport as compared with the continuous slewing action of such machines as full-circle cranes and single-bucket excavators the simplified construction of the turntable described herein is fully suitable for the functioning of the bucket-wheel trench excavator which constitutes the present invention.

As compared with the turntable of the rolling-contact type employed in the aforesaid machines, the turntable described herein is simpler, cheaper and easier to manufacture. At the same time the compactness and small size of the mechanism provide for free accommodation of the transmission and easy access to all the components thereof.

BRIEF DESCRIPTION OF THE DRAWING

Now the invention will be described in detail with reference to the accompanying drawings in which.

DETAILED DESCRIPTION

Figure 1:
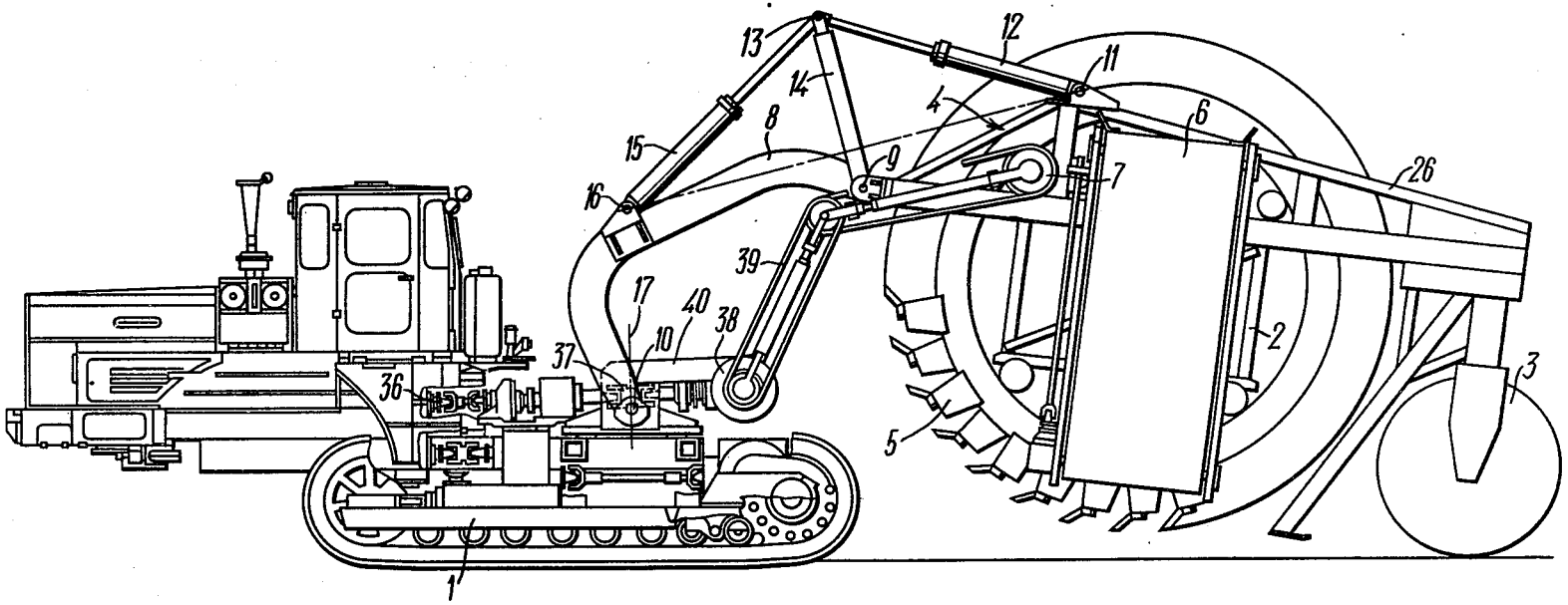
FIG. 1 is a side elevational view showing the bucket-wheel trench excavator in the transport position and diagrammatically illustrating the system for connecting and mounting the excavating unit to the tractor.
Figure 2:
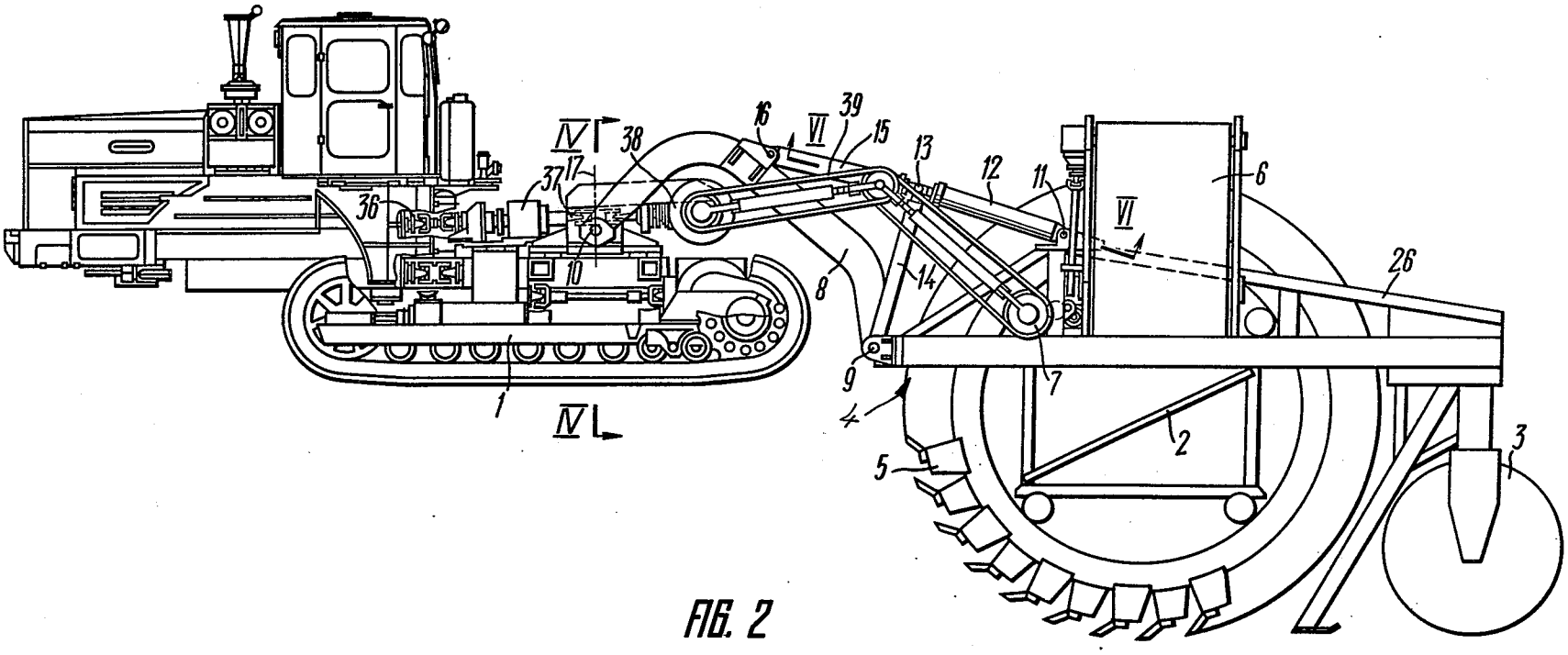
FIG. 2 is a side elevational view of the bucket-wheel trench excavator in the working position.
Figure 3:
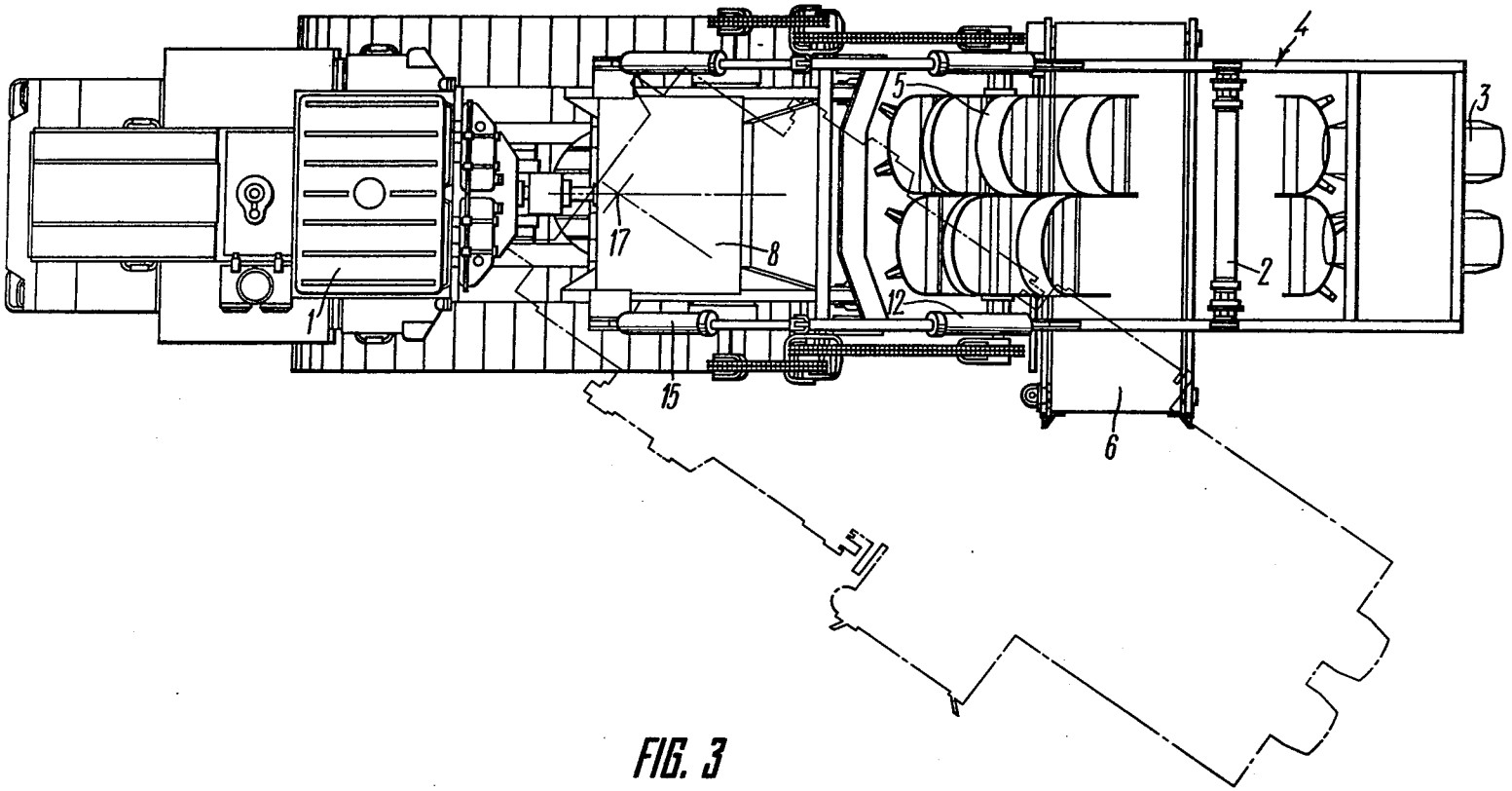
FIG. 3 is a plan view of the bucket-wheel trench excavator in the transport position.

The bucket-wheel trench excavator (FIGS. 1, 2 and 3) comprises a tractor (prime mover) 1 and a semitrailed excavating unit 2 whose rear end rests on a wheeled support 3 when the machine is either in the working or in the transport position.

The frame 4 of the excavating unit 2 is a load-carrying structure arranged to mount a bucket wheel 5, the wheeled support 3, a conveyor 6 and components of bucket-wheel drive 7.

The excavating unit is connected to the tractor by means of an intermediate frame 8 at the front and rear ends of which are provided horizontal-pivoted joints 9 and 10 designed to attach said intermediate frame to the excavating unit frame and the tractor frame.

Two hydraulic cylinders 12 and 15 are arranged in succession. One end of the first hydraulic cylinder 12 is attached to articulated joints 11 provided on the upper structure of the frame 4 of the excavating unit 2. The other end of the first hydraulic cylinder 12 is connected by means of articulated joints 13 to a diagonal strut 14 and the second hydraulic cylinder 15. The other end of the second hydraulic cylinder 15 is connected by means of an articulated joint 16 to the intermediate frame 8.

The lower end of the diagonal strut 14 is articulated coaxially with the horizontal-pivoted joint 9 which forms a connection between the excavator unit frame and the intermediate frame.

The frames 4 and 8 and the hydraulic cylinders 12 and 15 form a four-element linkage wherein the frame 4 of the excavating unit 12 and the intermediate frame 8 are rigid members, the two hydraulic cylinders 12 and 15 are arranged in succession, and the articulated joints 9 and 13 provided between the rigid frames and between the hydraulic cylinders are connected by means of the strut 14 designed to effect kinematic connection between the two frames and the hydraulic cylinders.

Figure 4:
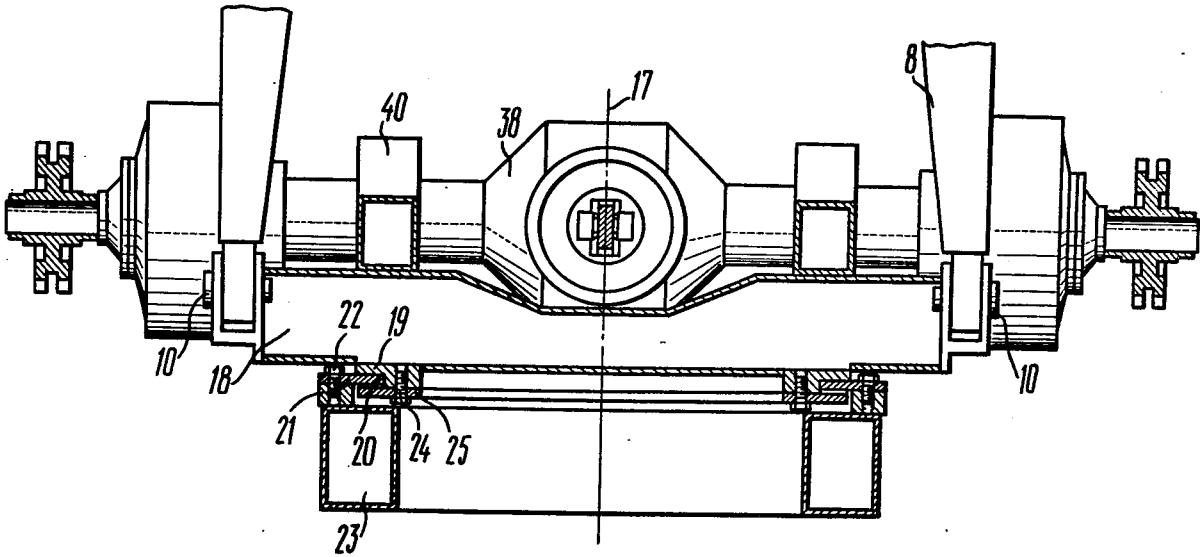
FIG. 4 is a cross-sectional view taken along the line IV—IV in FIG. 2 through the slidably mounted turntable effecting connection between the tractor and the excavating unit.

The vertical-pivoted joint 17 (FIGS. 1, 2, 3) which enables the excavating unit to rotate in relation to the tractor in negotiating turns is constructed in the form of a slidably mounted flat turntable which comprises a crossmember 18 (FIG. 4) connected by means of horizontal-pivoted joints 10 (FIGS. 1 and 4) to the intermediate frame 8.

The crossmember 18 is rigidly mounted on a rotatable disk 19. A stepped recess 20 may be provided round the periphery of the disk in order to accommodate a stationary ring 21 attached by means of fasteners 22 to the frame 23 of the prime mover 1. In order to limit axial movement of the disk 19, the crossmember 18 and the entire excavating unit, a locking ring 25 is provided under the stationary ring 21 on the recessed side of the disk and coaxially therwith. Said locking ring is secured by means of fasteners.

For the purpose of increasing the rigidity and strength of the frame 4 of the excavating unit 2, the frame upper structure 26 may be constructed in the form of a straight member, the entire frame 4 taking the form of a triangulated truss. This constructional arrangement provides for accommodating the conveyor 6 under the frame upper structure 26.

Figure 5:
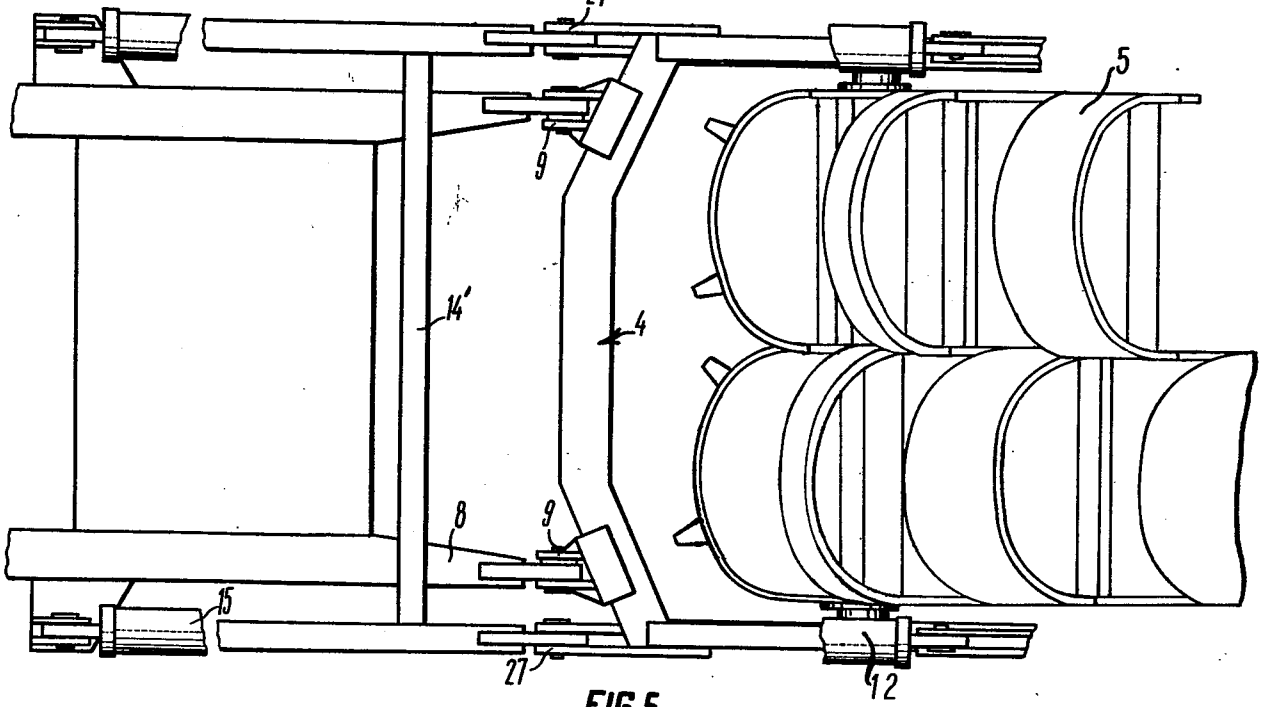
FIG. 5 is a top plan view of the separate horizontal-pivoted joints connecting the excavating unit frame to the intermediate frame and the strut.

The strut 14 which effects kinematic connection between the excavating unit frame 4, the intermediate frame 8 and the hydraulic cylinders 12 and 15 may be mounted independently with respect to the lower horizontal pivoted joint 9 connecting the intermediate frame to the excavating unit frame as shown in FIG. 5 at 14'. Said independent mounting may be accomplished by the use of articulated joints 27 installed in or out of line with the joints 9.

Figure 6:
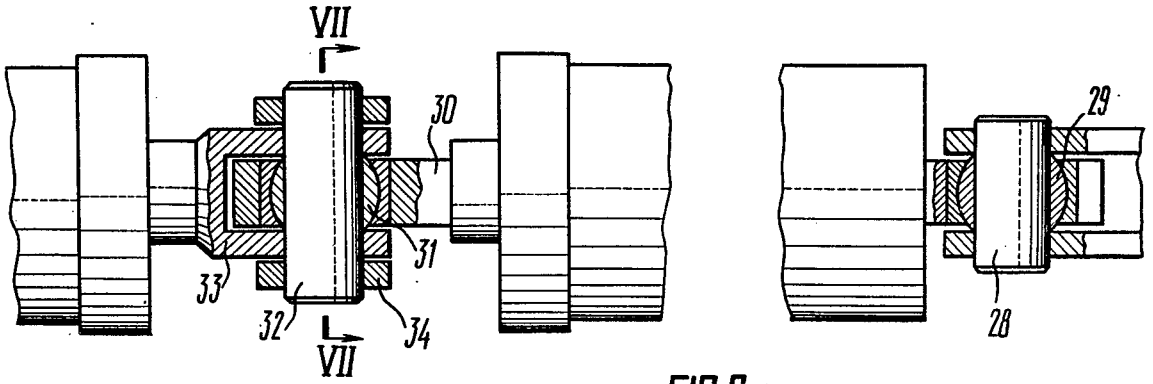
FIG. 6 is a sectional view taken on the line VI—VI in FIG. 2, showing the ball-joint attachment of the hydraulic cylinders to the excavating unit frame and to the strut.

The articulated connections 11 and 16 (FIGS. 1, 2) which hold the hydraulic cylinders to the excavating unit frame 4 and the intermediate frame 8 may be constructed in the form of ball joints comprising pins 28 (FIG. 6) and fulcrum balls 29.

The piston rods of the hydraulic cylinders and the upper end of the strut 14 (FIGS. 1, 2) may be connected coaxially by means of the joint 13.

Figure 7:
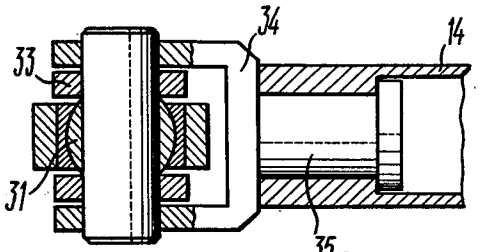
FIG. 7 is a sectional view taken on the line VII—VII in FIG. 6, showing the articulated connection of the strut to the hydraulic cylinder piston rod attaching pin and yokes.

The piston rod 30 (FIGS. 6, 7) of one of the hydraulic cylinders is ball-jointed as at 31 to a pin 32. The piston rod of the other hydraulic cylinder is connected to the pin 32 by means of a yoke 33. The pin 32 is articulated to another yoke 34 which is mounted rotatably in relation to the strut 14 by virtue of a cylindrical shank 3.

Another embodiment of the connection between the hydraulic cylinders and the strut provides for the cylinders to be attached to the strut independently and not coaxially by means of separate joints which may be of ball or other construction.

The mechanical transmission which conveys power to the bucket wheel receives drive from the tractor power takeoff 36 (FIGS. 1, 2) and comprises reduction gears and cardan drives 37 located above the turntable and the crossmember 18. The bucket-wheel drive reduction gear 38, which is connected to the transmission by means of a cardan drive and to the bucket wheel by means of chain drives 39, is fixedly mounted to the brackets 40 (FIGS. 1,2,4) of the turntable crossmember 18.

The bucket-wheel trench excavator constructed as described herein operates as follows:

Extending the two successively arranged cylinders 12 and 15 causes the intermediate frame 8 to turn about the front and rear horizontal-pivoted joints 10 and 9 which connect the intermediate frame 8 to the turntable crossmember 18 and the excavating unit frame 2. During this action the front joint 10 remains in place, whereas the rear joint 9 rises together with the front end of the excavating unit frame and all the associated components of the excavating unit, the rear end of the excavating unit constantly bearing on the wheeled support 3. Accordingly, by the action of this mechanism the machine is set in the working and transport positions and the depth of digging is varied.

When the intermediate frame 8 turns in relation to the excavating unit frame 4, the hydraulic cylinders 12 and 15 interact with the excavating unit frame, the intermediate frame and the diagonal strut 14 by virtue of the four-element linkage wherein the intermediate frame 8 and the excavating unit frame 4 are rigid elements, the two hydraulic cylinders 12 and 15 are arranged in succession, and the articulated joints provided between the frames and between the hydraulic cylinders are connected by the strut 14.

Owing to this constructional feature, when the intermediate frame is turned relatively to the excavating unit frame to either partial or full extent of its travel, i.e. throughout all the frame positions, a long and substantially non-decreasing distance is maintained between the axis of the hydraulic cylinders and the articulated joint 9 which connects the intermediate frame 8 to the excavating unit frame 4.

If the intermediate frame were turned in a conventional manner (for example, as described in USSR Inventor's Certificate No. 377486), i.e. by means of one hydraulic cylinder attached to the joints 11 and 16, the axis of the cylinder would lie on the line connecting said joints (FIG. 1), and the distance therefrom to the joint 9, as can be seen from the drawing, would be many times less that the distance to the axis of any of the cylinders 12 and 15 employed in the construction according to the invention.

Owing to this construction, the hydraulic cylinders, articulated joints and load-bearing structures are not subjected to great stresses and thereby the strength, weight and size of the mechanism can be reduced.

Should an attempt be made to position one hydraulic cylinder between the joints 11 and 16 at the same distance from the joint 9 as the distance therefrom to the axis of any of the cylinders 12 and 15, with the intermediate frame turned to the maximum angle (i.e. with the machine in the transport position, FIG. 1), the transfer of the machine into the working position (FIG. 2) would require a very long cylinder stroke (over 2 m in the case of a heavy machine), the length of the cylinder and the overall dimensions of the machine increasing beyond the permissible limits.

Thus, the construction described herein provides for making bucket-wheel trench excavators featuring moderate weight, ease of transportation, dependability and handiness along with ample power, high working capacity and capability of digging large trenches in difficult and frozen ground.

The vertical-pivoted joint 17 (FIGS. 1, 2, 3) constructed in the form of a slidably mounted flat turntable enables the excavating unit 2 and the intermediate frame 8 to turn in a horizontal plane to provide for manoeuvring in the transport position and digging trenches with small radii of curvature.

The horizontal-pivoted joint 10 connects the front end of the intermediate frame 8 to the crossmember 18 (FIG. 4) fixedly mounted on the rotatable disk 19. Mounted to the brackets 40 provided on the crossmember 18 is the bucket-wheel drive reduction gear 38 which transmits rotational motion through the articulated chain drives 39 to the bucket wheel 5. When the excavating unit turns relatively to the tractor in a horizontal plane, the articulated chain drives 39 and the reduction gear 38 turn together with the excavating unit and the intermediate frame.

The bucket-wheel power transmission, which includes the reduction gears and cardan drives 37 and the bucket-wheel drive reduction gear 38, is located above the turntable and is open to give free access for mounting, repair and maintenance.

The crossmember 18 (FIG. 4) turns together with the disk 19 and the locking ring 25 relatively to the stationary ring 21 accommodated in the stepped recess 20 in the disk 19 and fixedly mounted to the frame 23 of the prime mover 1.

The locking ring 25 limits upward axial movement and tilting movement of the disk 19 and, consequently, of the crossmember 18, the intermediate frame 8 and the entire excavating unit 2.

Inasmuch as the stepped recess 20, the locking ring 25 and the stationary ring 21 are located round the periphery of the disk 19, the entire structure, including the crossmember 18, easily takes heavy traction and, in particular, tilting loads transmitted from the excavating unit to the tractor during work or travel or transverse slopes or when digging difficult and frozen ground.

The simplicity of manufacture, the moderate size, the dependability in transmitting heavy loads from the excavating unit to the tractor with the frequency of functioning required for the bucket-wheel trench excavator - all these features render this construction cheap, efficient and advantageous.

The fulcrum balls 29 mounted on the pins 28 which hold the hydraulic cylinders to the excavating unit frame and the intermediate frame can accommodate some misalignment of the ball joints with the common axis of the cylinders in the transverse plane perpendicular to the plane in which the joints move (said misalignment may be due assembly faults or structural deformation. By this construction, forces are always transmitted along the cylinder axis, there being no bending loads on the barrels, pistons and rods of the hydraulic cylinders.

At the mid-point, where the joint 13 is located and the cylinder piston rods are connected to each other and to the upper joint of the strut 14 coaxially, owing to which decrease is effected in the required distance between the joints 16 and 11 provided on the intermediate frame and the excavating unit frame, transverse displacement and misalignment of the hydraulic cylinder joints are accommodated, firstly, by virtue of the piston rod 30 of one of the hydraulic cylinders being ball-jointed as at 31 to the pin 32 and, secondly, by the use of the yoke 33 which connects the piston rod of the other hydraulic cylinder to the pin 32 which, in turn, is connected to the yoke 34 having a shank 35 articulated to the upper end of the strut 14. Thus, the piston rod 30 of one of the cylinders can turn about the pin 32 on the fulcrum ball 31 through some angle in a transverse plane, whilst the piston rod of the other hydraulic cylinder, together with the yoke 33, pin 32 and yoke 34, can also turn in a transverse plane through the required angle by virtue of the shank 35.

The force from the hydraulic cylinders 15 and 12 is transmitted to the excavating unit frame 4 and its upper structure 26. Owing to the fact that the frame upper structure is constructed in the form of a straight member, the cylinder forces subject it, in the main, only to compression and tension. Inasmuch as the frame is of trussed construction, its members are substantially free from bending stresses and thereby the entire frame is rendered more strong and rigid without increase in the cross-sectional dimensions and weight. At the same time the frame upper structure 26 provides interior space for the accommodation of the conveyor 6 and the passage of the ground carried thereby.

The strut 14 which connects the frames to the hydraulic cylinders is provided at its lower end with joints 27 mounted independently with respect to the lower horizontal-pivoted joint 9 disposed at the lower point of the four-element linkage for the purpose of connecting the intermediate frame to the excavating unit frame.

The independent mounting of the strut 14 simplifies the construction and makes it possible to decrease the height of the machine so as to comply with the railway or other transport dimensional limitations.

For transportation by rail or in other conditions where dimensional limitations have to be complied with, the upper and lower buckets are removed from the bucket wheel and the excavating unit is lowered so as to rest on the bucket-wheel rims. The lower articulated joint 27 of the strut 14 is disconnected from the excavating unit frame, whilst the excavating unit remains connected to the intermediate frame 8 and the tractor 1. The strut 14 is lowered by retracting the hydraulic cylinders 12 and 15 and thereby the uppermost point of the machine is lowered. By this provision the need for disassembling the major bulky components (the excavating unit 2, tractor 1 and intermediate frame 8) is obviated and the labour required to prepare the machine for transportation is materially saved.

To reinstall the strut 14, the hydraulic cylinders are extended so as to bring the strut 14 level with the joints 27 and thereafter the strut 14 is reconnected to the excavating unit frame. All these operations can be performed without resort to hoisting facilities.

Referring to description given herein, the bucket-wheel trench excavator constituting the present invention has a perfect system for mounting and connecting the excavating unit to the tractor. Said system makes it possible to decrease loads imposed on the stressed components of the machine and also to reduce the weight of the machine, whereby, in virtue of the reserve obtained, increase is effected in the capability of the excavator to dig large trenches in various types of ground, frozen ground included. Said excavator can travel over long distances for transportation purposes, has a moderate size and is simple to manufacture and easy to service.

What is claimed is:

1. A bucket-wheel trench excavator comprising: a prime mover; a bucket-wheel excavating unit arranged to bear on a wheeled support, a prime mover frame and an excavating unit frame; an intermediate frame connected to said prime mover frame and said excavating unit frame; front and rear horizontal-pivoted joints respectively connecting said intermediate frame to said primer mover frame and said excavating unit frame; two hydraulic cylinders respectively articulated to said intermediate frame and to said excavating unit frame to transfer said excavating unit between a working position and a transport position by turning said intermediate frame about said front and rear horizontal-pivoted joints; a four-element articulated linkage formed by the frames and the hydraulic cylinders in which linkage said intermediate frame and said excavating unit frame are rigid members and said two hydraulic cylinders are pivotably connected in succession; a strut in said four-element linkage effecting kinematic connection between said frames and hydraulic cylinders and connecting the four-element likage joints provided between said rigid frames and between said hydraulic cylinders to enable said rigid members, said hydraulic members, said strut and said joints all to undergo simple and composite motion in space in the course of extension and retraction of said cylinders and cause the point of connection between the cylinders to undergo conjoint pivotal movement with respect to said front and rear horizontal-pivoted joints such that the excavating unit and wheeled support undergo composite motion produced by the composite movement of the joint of connection between the cylinders and the pivot movement of said rear joint in conjunction with the length change of said cylinders to produce substantial movement of said excavating unit towards said prime mover frame in going from said working position to said transport position; a vertical-pivot joint on said prime mover frame to enable said excavating unit and said intermediate frame to turn in relation to the prime mover, said vertical-pivot joint comprising a flat turntable having a rotatable disk and a crossmember mounted on said turntable and connected by said horizontal-pivoted joints to said intermediate frame such that said intermediate frame is pivotably movable around said horizontal-pivoted joints.

2. An excavator as claimed in claim 1, in which the hydraulic cylinders are connected to the excavating unit frame and the intermediate frame by means of ball joints and the piston rods of the hydraulic cylinders are coaxially connected to each other and to the strut by means of a pin, a fulcrum ball mounted thereon, and a yoke arranged to turn relative to the strut about an axis perpendicular to the axis of the pin.

3. An excavator as claimed in claim 1, in which, in order to increase the rigidity and strength of the excavating unit frame, said frame includes an upper structure in the form of a straight member, the entire frame taking the form of a triangulated truss.

4. An excavator as claimed in claim 1, in which said strut has a lower end with a pivot connection mounted coaxially and independently with respect to the lower horizontal-pivoted joint in the four-element linkage connecting the strut to the excavating unit frame.

5. An excavator accroding to claim 1, in which a stepped recess is provided in the bottom portion of the turntable disk at the periphery thereof to limit axial and horizontal displacement, a stationary ring being accommodated in said recess and connected to the prime mover frame, and a locking ring fastened under the stationary ring coaxially therewith to limit disk axial movement, said locking ring having an upper slidable surface for said stationary ring.

* * * * *